US006270210B1

(12) United States Patent
Yamaguchi et al.

(10) Patent No.: US 6,270,210 B1
(45) Date of Patent: Aug. 7, 2001

(54) METHOD FOR CONSTRUCTING AN INK CARTRIDGE

(75) Inventors: Shuichi Yamaguchi; Yoshio Miyazawa, both of Nagano (JP)

(73) Assignee: Seiko Epson Corporation, Nagano-ken (JP)

( * ) Notice: Subject to any disclaimer, the term of this patent is extended or adjusted under 35 U.S.C. 154(b) by 0 days.

(21) Appl. No.: 09/556,636

(22) Filed: Apr. 24, 2000

Related U.S. Application Data

(63) Continuation of application No. 08/946,461, filed on Oct. 7, 1997, now Pat. No. 6,053,606.

(30) Foreign Application Priority Data

| | | |
|---|---|---|
| Oct. 7, 1996 | (JP) | 8-284691 |
| Feb. 17, 1997 | (JP) | 9-32484 |
| Jun. 27, 1997 | (JP) | 9-187590 |
| Aug. 19, 1997 | (JP) | 9-237795 |

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 5,307,091 | * | 4/1994 | DeCoste | 347/86 |
| 5,400,066 | * | 3/1995 | Matsumoto et al. | 347/86 |
| 5,852,458 | * | 12/1998 | Scheffelin et al. | 347/86 |
| 5,874,976 | * | 2/1999 | Katon et al. | 347/85 |
| 5,886,718 | * | 3/1999 | Johnson et al. | 347/85 |

* cited by examiner

*Primary Examiner*—N. Le
*Assistant Examiner*—Michael Nghiem
(74) *Attorney, Agent, or Firm*—Stroock & Stroock & Lavan LLP

(57) ABSTRACT

A method of constructing an ink cartridge is disclosed. The method comprises the steps of: providing an ink bag with an ink supply port at one end and an ink charge opening at an opposite end thereof; then affixing a back member to an external flat side of the ink bag; then suspending the ink bag with the ink supply port facing downward and charging a predetermined amount of ink into the ink bag via the ink charge opening; then permanently sealing the ink charge opening; keeping the ink bag flat with the back member; and affixing the back member to the bottom of a case main body.

5 Claims, 12 Drawing Sheets

METHOD FOR CONSTRUCTING AN INK CARTRIDGE

CROSS REFERENCE TO RELATED APPLICATIONS

This application is a continuation of application Ser. No. 08/946,461 filed Oct. 7, 1997, now U.S. Pat. No. 6,053,606.

BACKGROUND OF THE INVENTION

The present invention relates generally to an ink cartridge that supplies ink to a recording head, and, in particular, to an improvement in the protection of the ink bag of an ink cartridge wherein the ink bag is accommodated in a case main body along with an ink depletion detecting plate affixed to the ink bag.

Generally an ink jet recording apparatus is designed to print data by causing the recording head thereof to reciprocally move along the width of a recording sheet. Ink is supplied from an ink supply source to the recording head. As a result of such a construction, an ink jet recording apparatus that must produce a large number of copies must carry a large-sized ink cartridge, which cannot be mounted on a carriage. Hence, the ink cartridge is mounted on the housing of the recording apparatus and the ink is supplied to the recording head through a tube.

Reference is made to FIG. 16 in which an example of such a prior art ink jet recording apparatus is shown. A case main body 63 contains an ink bag 62 which includes an ink supply port 64. Ink cartridge 61 is connected via a tube 65 to a sub tank 66 located on a carriage 67. In this manner, ink can be supplied from the sub tank 66 to a recording head affixed to a lower surface of the carriage 67. The apparatus housing 60 also contains a waste ink tank 70.

Supplying the ink in this manner significantly increases the number of copies that can be printed by using only one cartridge as compared with the case where the ink cartridge is mounted on the carriage. However, the large size of the ink cartridge results in a large recording apparatus, which is a problem.

Unexamined Japanese Patent Publication No. Hei. 5-16378 discloses the design of such an ink cartridge. An ink depletion detecting plate 69 (FIG. 17) is secured to the upper surface of the flexible ink bag 62 to cover part of the upper surface of the ink bag. The ink depletion detecting plate has a detecting piece which projects out from a side thereof and aligns with a window located in the case main body. A displacement of this detecting piece is sensed by an ink end detector disposed on the main body of the recording apparatus.

In an effort to overcome this problem, the ink bag 62 has been accommodated in a housing 60 in such a manner that a side surface along the length of the ink bag 62 extends vertically with respect to the corresponding side surface of the housing 60, thereby decreasing the area needed to mount the ink cartridge 61 which results in the desired downsizing of the recording apparatus. Additionally, the size of the ink bag is increased to use any dead space within the housing which results in an increase in the ink capacity of the recording apparatus.

The prior art ink bag has been satisfactory. However, an increase in the size of the ink bag results in an increase in the area that is not covered by the ink depletion detecting plate. Subsequently, when the ink bag is subjected to vibrations during transportation or if the ink cartridge is dropped, the area of the ink bag 62 not covered by the ink depletion detecting plate 69 is shaken at a large amplitude. This results in the collision of the uncovered area of the ink bag with the side walls of the case main body. The uncovered area of the ink bag can also be subjected to bending, twisting or rubbing of the ink bag boundary with the ink depletion detecting plate. Consequent damage to the ink bag can result in the breaking of the bag or impairment of its air shielding characteristics.

Further, to prevent deformation of the ink bag and thereby ensure stable, consistent discharge of ink to the recording head, the shape of the ink bag is maintained by securing a flat area of the ink bag to the bottom on the case main body 63. Additionally, this attachment prevents damage to the ink bag 62 during transportation.

However, in some cases, shaking of the ink at the time when the bottom, flat surface of the ink bag is affixed to the case main body with an adhesive 68, results in the creation of wrinkles on the thus attached surface of the ink bag. These wrinkles extend parallel with the short side of the rectangular ink bag. Moreover, ink bags prepared by using a thick film to increase air shielding characteristics have wrinkles that do not collapse. These wrinkles cause problems with the flow of the ink resulting in the blockage of the ink to the ink supply port 64 which in turn causes the ink to stagnate in the ink bag. Additionally, the wrinkles cause the ink depletion detecting plate to float by a certain height G from the bottom of the ink cartridge. This condition persists even when there is no more ink left in the ink bag thus preventing the accurate detection of an ink end.

SUMMARY OF THE INVENTION

Generally speaking in accordance with the invention, an ink cartridge includes a case main body. A flat flexible ink bag is formed so as to be substantially rectangular and has an ink supply port formed on a short side thereof. An ink depletion detecting plate is fixed to one of the flat regions of the ink bag and has an outwardly projecting detecting piece. Another flat region of the ink bag is fixed to a bottom of the case. A cover covers an opening of the case main body. In an exemplary embodiment, the ink depletion detecting plate has projecting pieces on at least one long side thereof, the projecting pieces being such as to extend outward beyond an outer edge of the ink bag and such as to allow front ends thereof to come in contact with a side wall of the case main body.

A projecting piece extending outward beyond an outer edge of the ink bag is formed at least on a single side of the ink depletion detecting plate. The projecting piece is a short distance from said case to come in contact with the side wall of the case main body at a short stroke of the ink depletion detecting plate. Short stroke length is defined as a distance short enough in length to prevent vibration in the ink bag when the cartridge is shaken, dropped or the like. As a result, the amount of deformation of the ink bag during transportation or the like can be suppressed as much as possible.

Accordingly, it is an object of this invention to provide an improved ink cartridge capable of preventing damage to the ink bag due to shaking, accidental dropping and other such actions during the distribution process.

Another object of the invention is to provide an improved ink cartridge capable of reliably discharging ink by preventing the wrinkling of the ink bag where it is attached to the case main body.

Still another object of the invention is to provide an improved ink cartridge capable of correctly detecting ink depletion by preventing the wrinkling of the ink bag where it is attached to the case main body.

A further object of the invention is to provide an improved ink cartridge capable of keeping the amount of deformation of the ink bag to a minimum thereby protecting the ink bag from damage during transportation.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
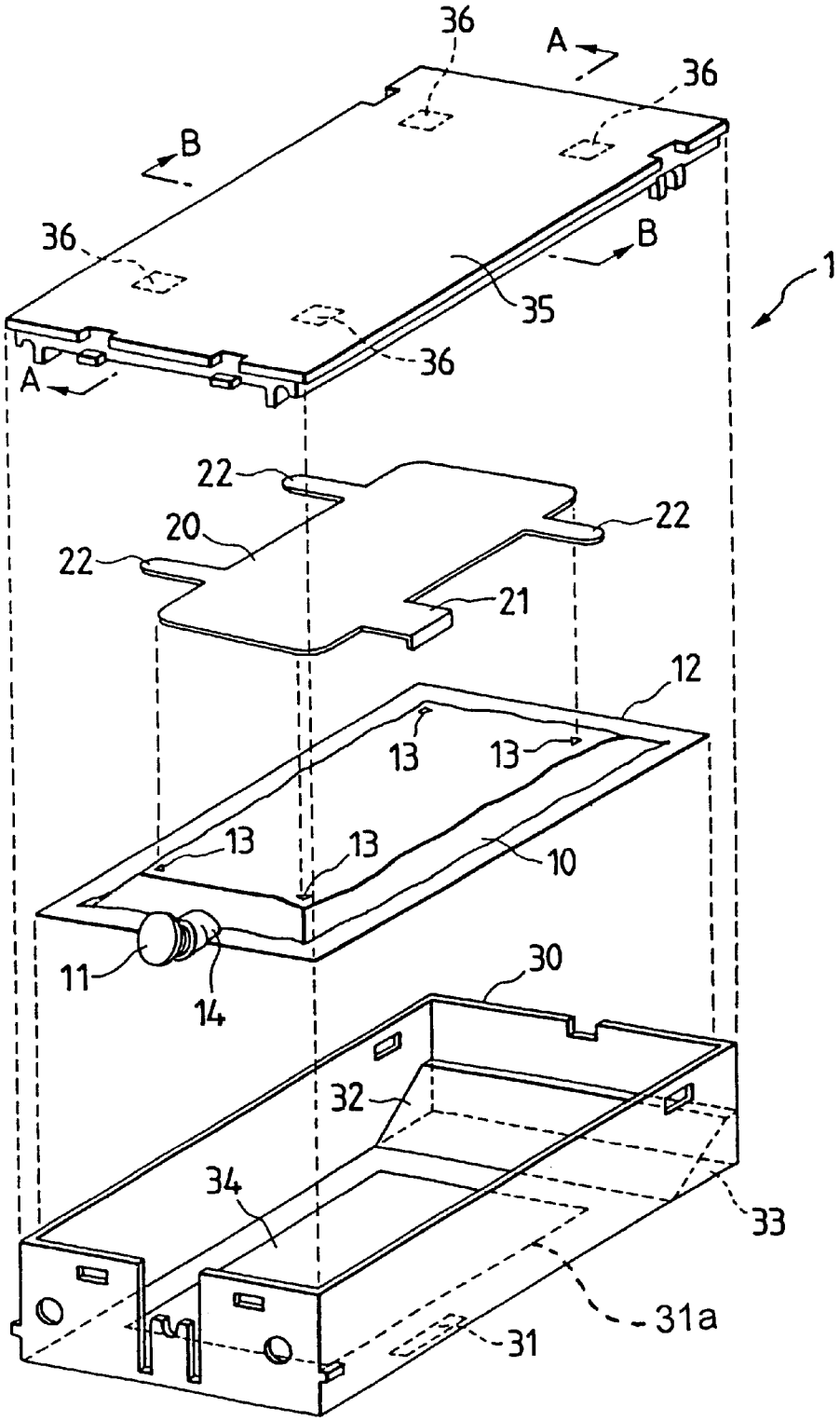
FIG. 1 is an exploded perspective view of a first embodiment of an ink cartridge constructed in accordance with the present invention.

Reference is made to FIG. 1 which illustrates an ink cartridge, generally indicated as 1, constructed in accordance with a first embodiment of the invention. Ink cartridge 1 includes a case main body 30, a flat, flexible, rectangular ink bag 10 with ink sealed therein and an ink depletion detecting plate 20. Ink depletion detecting plate 20 has an extending detecting piece 21 on a long side thereof. The detecting piece 21 serves to operate an ink depletion detector, not shown, constructed of a light switch or similar device. Case main body 30 accommodates the ink bag 10 and the ink depletion detecting plate 20. A cover 35 seals an open end of case main body 30.

The front surface of the ink bag 10 facing the open end of the case main body 30 is affixed to ink depletion detecting plate 20 with an adhesive, a pressure sensitive adhesive double coated tape or by similar means, not shown. The rear surface of the ink bag 10 is affixed to the bottom of case main body 30 with an adhesive 34, a pressure sensitive adhesive double coated tape, or by similar means. The adhesive is such that it allows the ink bag 10 to be released from the case main body 30.

Further, in a preferred embodiment, ink bag 10 is constructed of an aluminum laminated film formed by interposing an aluminum foil between two films, e.g., a nylon film on the outer side and a polyethylene film on the inner side so that gas barrier characteristics can be ensured. The aluminum laminated film has an opening on a short side thereof. A conduit 14, allowing a molded ink supply port 11 to be attached thereto, is attached to an opening on the short side of ink bag 10 by thermal fusion.

A flat region 200 of ink bag 10 forms a front surface side of the ink bag 10, the surface facing the open end of case 30. Positioning marks 13 are provided on flat region 200 and provide support for the ink depletion detecting plate 20. The positioning marks 13 facilitate the positioning of the detecting piece 21 found on the ink depletion detecting plate 20 by causing the detecting piece 21 to confront a window 31 located in the bottom of the case main body 30.

Figure 2:
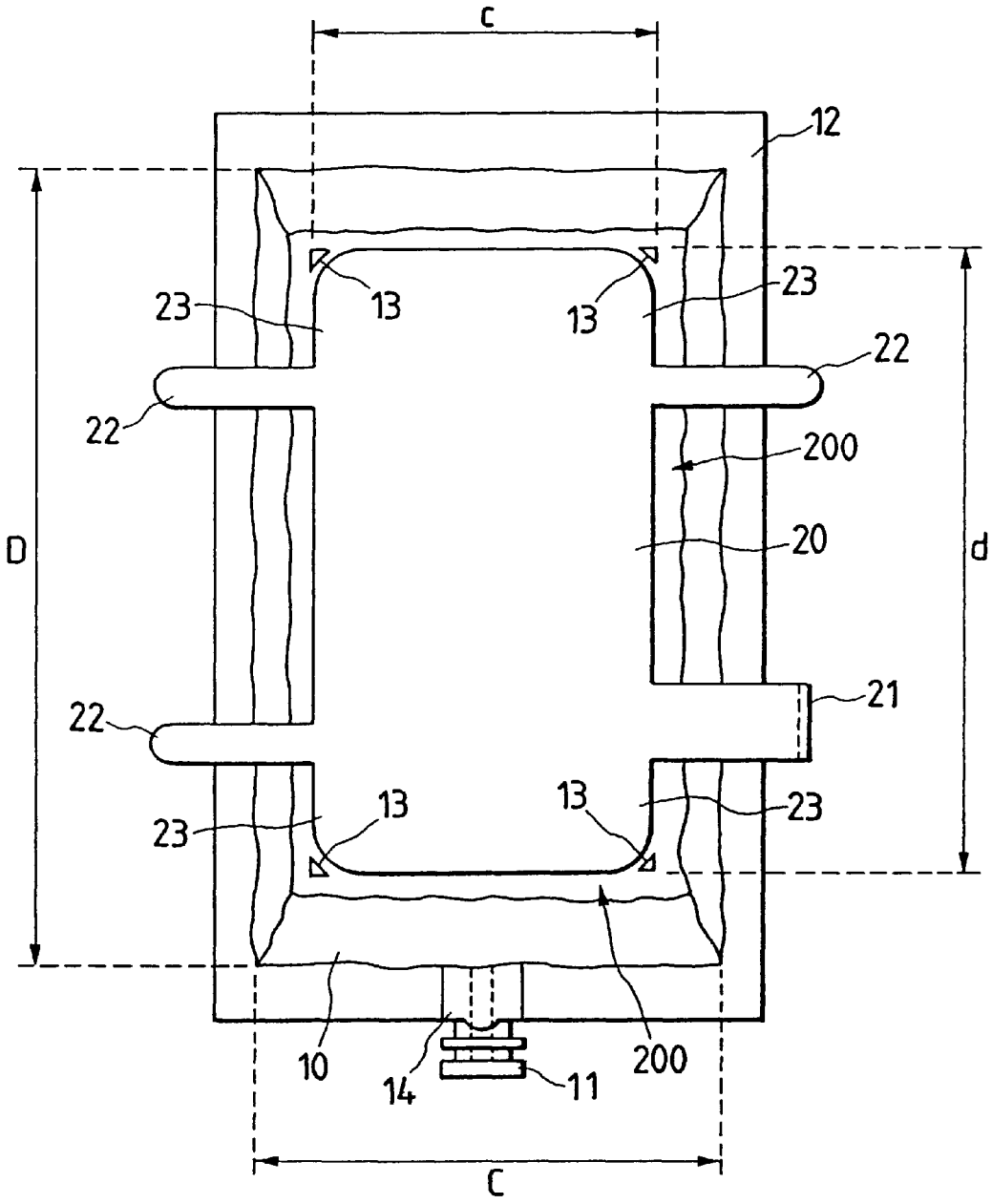
FIG. 2 is a top plan view of the open ink cartridge showing an ink depletion detecting plate with the ink bag constructed in accordance with the first embodiment of the present invention.

Further, the ink depletion detecting plate 20 is constructed of a thin plate having a rigidity such that it follows any deformation of the ink bag 10 caused by a change in the amount of ink in the ink bag 10. The four corners of the ink depletion detecting plate 20 are chamfered to have rounded portions 23 (FIG. 2). Additionally, the ink depletion detecting plate has projecting pieces 22 formed at least on a long side of detecting plate 20 opposite the long side on which the detecting piece 21 is formed. The projecting pieces 22 are located at positions that allow the front ends thereof to extend beyond an outer edge 12 of ink bag 10 and come in contact with the side wall 31A of the case main body 30.

Further, as shown in FIG. 2, the width c of detecting plate 20 and the length d of detecting plate 20 are set to values that are 0.6 times or greater, or more preferably, 0.6 to 0.9 times the width C and the length D of an ink containing region of the ink bag 10 when ink bag 10 is filled with ink. c represents the short length (width) of the ink depletion detecting plate 20, d represents the long length of the ink depletion detecting plate 20, C represents the short length (width) of the ink bag 10, and D represents the long length of the ink bag 10. Additionally, the area of the ink depletion detecting plate 20 is defined to values that are 0.3 times or greater, or more preferably 0.4 to 0.8 times the area of a flat region 200 of the ink bag 10.

Setting the area of the ink depletion detecting plate 20 slightly smaller than that of the ink containing region 200 of the ink bag 10, results in the ability to smooth out any wrinkles and slack that may be formed on the ink bag 10 when there is a small amount of ink in the ink bag 10. This in turn helps in the proper discharge of ink and allows for the correct detection of ink depletion.

Figure 3:
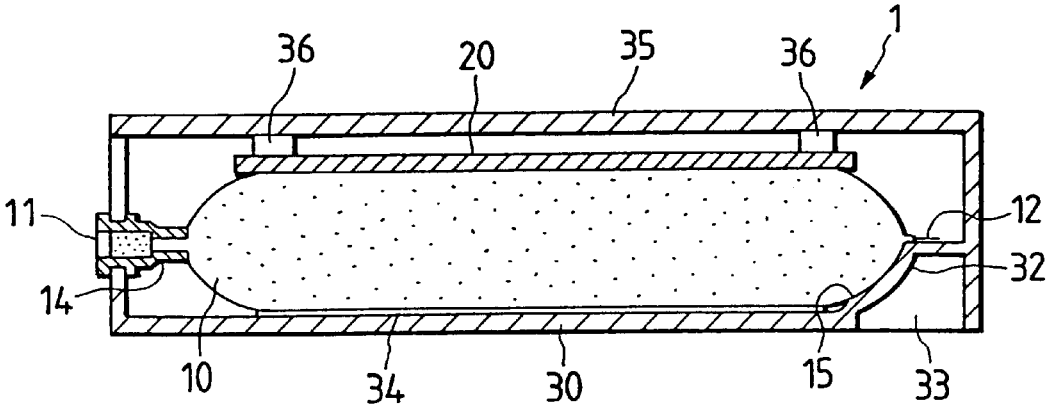
FIG. 3 is a cross-sectional view taken along line A—A of FIG. 1.

As shown in FIG. 3, the case main body 30 has a sloped portion 32 on the bottom of case 30 at an end of case 30 on the side opposing the ink supply port 11 of ink bag 10. This sloped portion 32 has a downward sloping surface which faces the opening of the case main body 30. The opposite surface thereof forms a recess 33 so that the sloped portion 32 can fit the shape of a swollen portion 15 of the ink bag 10. This arrangement within the case main body 30 allows for the attachment of the ink bag 10 to the bottom thereof with the adhesive 34 or similar means. This adhesion is made so as to be separable.

Figure 4:
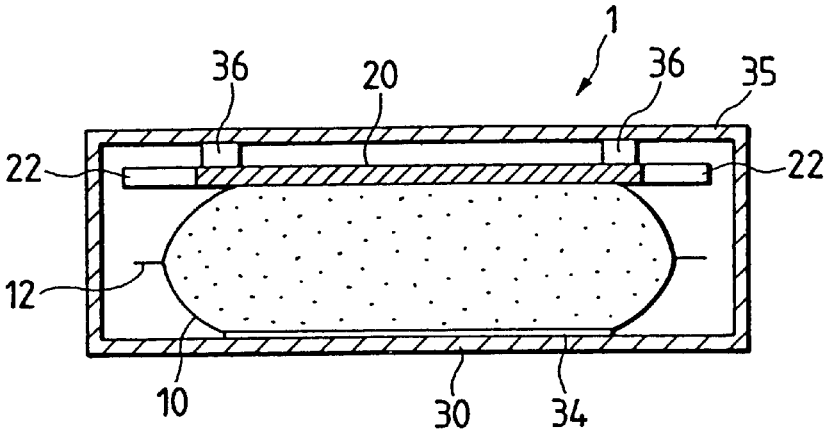
FIG. 4 is a cross-sectional view taken along line B—B of FIG. 1.

As shown in FIG. 4, there are a plurality of projections 36 on the back of the cover 35. When the ink bag 10 is filled with ink, these projections 36 are substantially in contact with a front surface, facing cover 35, of ink depletion detecting plate 20. These projections 36 are made preferably of elastic bodies and are scattered around so as to enhance the ability of the ink depletion detecting plate 20 to coincide with the flat region of the ink bag 10.

In this first embodiment, the ink cartridge 1 is assembled by affixing an ink filled ink bag 10 to the bottom of the case main body 30 with an adhesive 34 or a similar material. The four corners of the ink end detecting plate 20 are aligned with the positioning marks 13 of the ink bag 10. The ink depletion detecting plate 20 is then secured to the exposed surface of the ink bag 10 with a pressure sensitive adhesive double coated tape or a similar material. This results in the positioning of the detecting piece 21 in alignment with and confronting the window 31 of the case main body. As a final step, the opening of the case main body 30 is sealed by affixing the cover 35 to the top of the case main body 30.

Figure 5A:
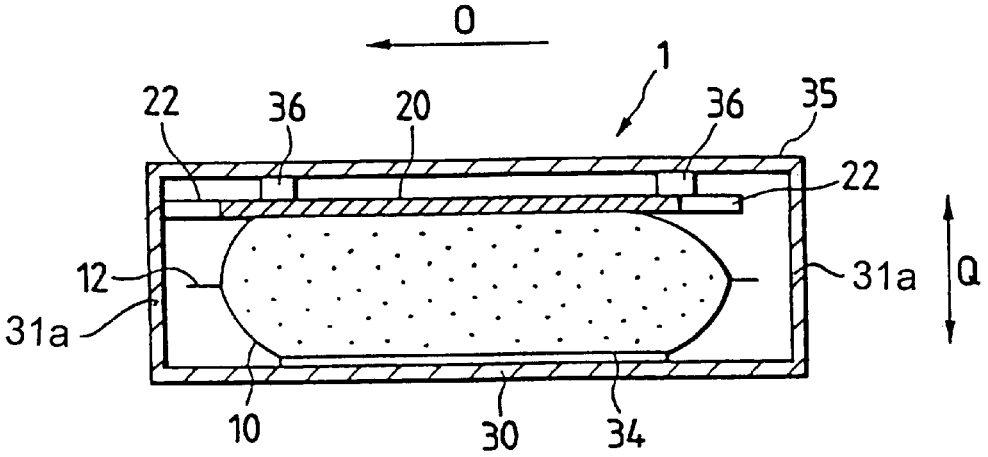
FIGS. 5(A) and 5(B) are cross-sectional views taken along line B—B of FIG. 1, showing the relationship between the ink bag and the case main body when the ink bag and the case main body have been shaken horizontally and vertically.
Figure 5B:
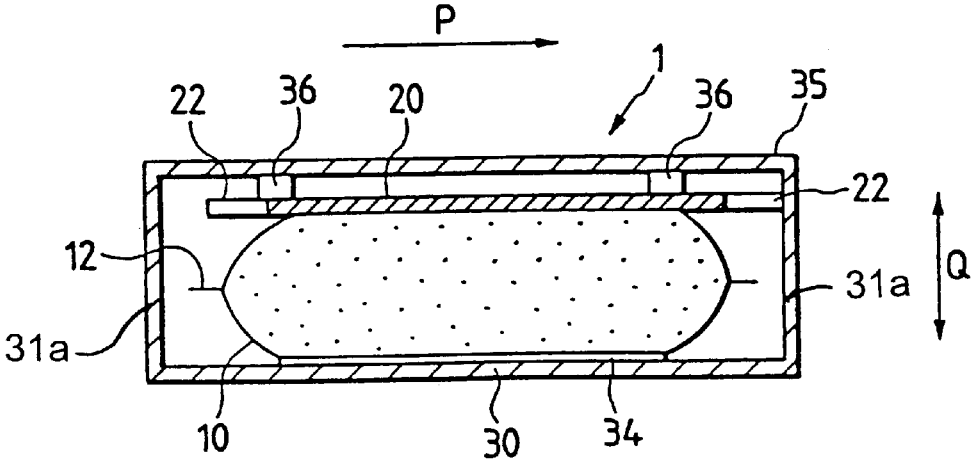

FIGS. 5A and 5B depict an ink filled ink bag 10 being subjected to pressure vibrations in the directions of arrows O, P during transportation or the like. The inertia of the ink filled ink bag 10 causes the application of this force to result in the vibration of the ink bag 10 along the width of the ink bag 10. However, since the upper surface of the ink bag 10 is fixed integrally to the ink depletion detecting plate 20 over a wide region, and since the projecting pieces 22 of the ink depletion detecting plate 20 come in contact with the side wall of the case main body 30 with extremely short displacements, the ink bag 10 is checked from shaking.

Further, when the ink cartridge 1 is subjected to vibrations in directions indicated by the arrows Q, in FIGS. 5(A), 5(B), the ink bag 10 tends to vibrate in the directions of thickness. However, the ink bag 10 has the lower surface thereof fixed to the bottom of the case main body 30 over a wide region with the adhesive 34 and has the upper surface thereof fixed over a wide region by the ink depletion detecting plate 20 that is pressed by the plurality of projections 36 arranged on the cover 35. Therefore, the ink bag 10 is also prevented from shaking. As a result of these actions, the ink bag 10 can be reliably checked from shaking when transported or dropped.

Additionally, the four corners of the ink depletion detecting plate 20 come in contact with the ink bag 10 over a wide area of the rounded portions 23 as depicted in FIG. 2. Therefore, there is no likelihood that the ink bag 10 will be damaged by scratching.

Further, the ink bag 10 has the ink supply port 11 fixed to the case main body 30. The side opposite the ink supply port 11 is supported by a sloped portion 32 on the bottom of the case main body 30 as shown in FIG.3. The ink bag 10 has a shape regulated by the rigidity thereof. Thus, the exposed region of the ink bag 10 amounting to about 20% of the width extending between long sides of the ink depletion detecting plate 20 can be checked from being deformed wherever possible. Hence, damage caused to the ink bag 10 by bending, twisting, and rubbing that tended to occur at the boundary of the ink bag 10 with the ink depletion detecting plate 20 in the prior art can be prevented.

Moreover, in the prior art, when the ink cartridge 1 is attached to the recording apparatus, the ink bag 10 gets deformed. On the other hand, in the present invention, the ink depletion detecting plate 20, which is in contact with the ink bag 10 on almost all the region, causes the ink bag to maintain a uniform shape resulting in the gradual consumption of the ink in the ink bag 10. As a result, even with a minimal amount of ink in the ink bag 10, the ink is discharged in a smooth manner. Additionally, such an arrangement is capable of correctly detecting an ink depletion when all the ink in the ink bag 10 is consumed.

Once the ink in the ink cartridge 1 has been consumed and an ink depletion is detected, the ink cartridge can be removed from the housing of the recording apparatus by hooking a finger in the recess 33 formed on the bottom of the case main body 30. Thus, the ink cartridge 1 can be withdrawn from the recording apparatus main body with ease.

The ink depletion detecting plate 20 is designed so as to have substantially the same size as the flat region of the ink bag 10 in the aforementioned embodiment. If each side of the ink depletion detecting plate 20 is set to a size so as to project beyond the outer edge of the ink bag 10 toward the side wall of the case main body 30, the projecting pieces 22 can be made as short as possible or dispensed with entirely.

Figure 6:
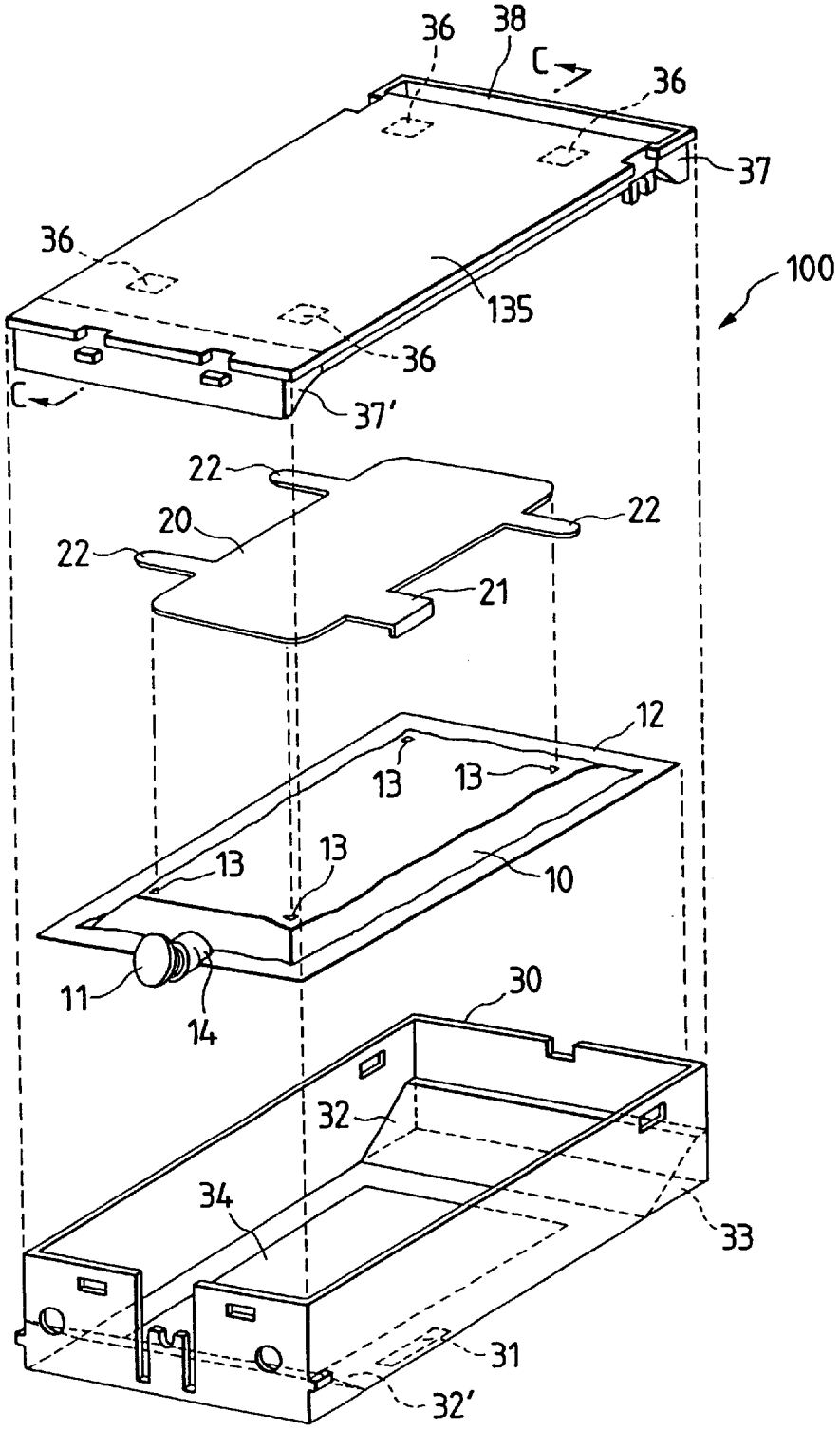
FIG. 6,.is an exploded perspective view illustrating a second embodiment of an ink cartridge constructed in accordance with the present invention.
Figure 7:
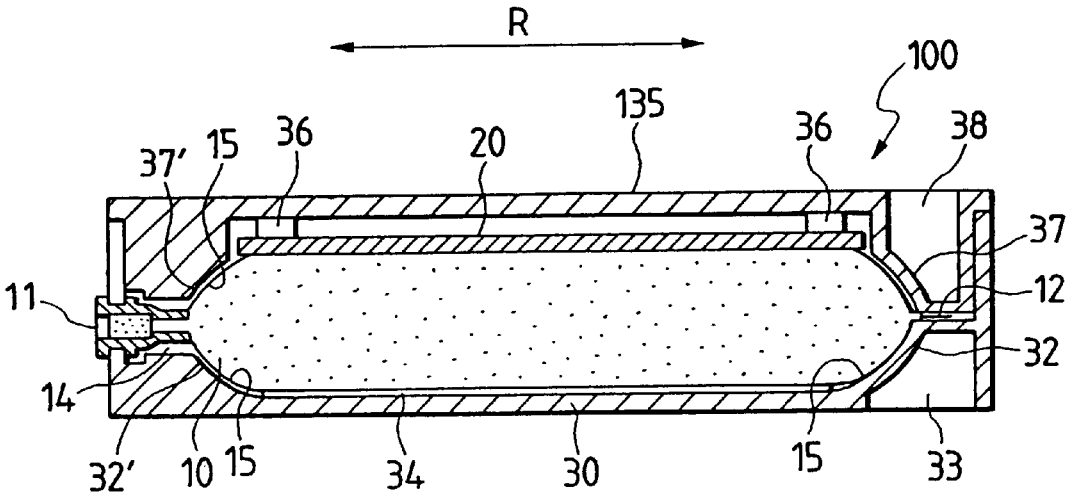
FIG. 7 is a cross-sectional view taken along a line C—C of FIG. 6.

Reference is now made to FIG. 6 in which a cartridge 100 constructed in accordance with a second embodiment of the invention is provided. Like structure is identified by like numerals. Ink cartridge 100 has a case main body 30 having a sloped portion 32' on the bottom of case 30 at the side of case 30 at which the ink supply port 11 is to be positioned. Sloped portions 32, 32' fit the shapes of the swollen portions 15 of the ink bag 10 as depicted in FIG. 7. The case main body 30 contains the ink bag 10 therein in such a manner that the ink bag 10 is separably fixed to the bottom thereof with the adhesive 34 or a similar material.

Further, the cover 35 has sloped portions 37, 37' on the bottom thereof that are disposed in confronting relationship with the sloped portions 32, 32' formed on case main body 30. The sloped portions 37, 37' are provided so as to fit swollen portions 15 of the ink bag 10 facing cover 35. The sloped portion 37 located on the opposite side of the ink supply port 11 is created by forming a recess 38 on the cover 35, and provides an additional handle for attaching and detaching the ink cartridge 1 along with the confronting recess 33.

When the ink cartridge 100 is subjected to vibrations in directions indicated by the arrows R as shown in FIG. 7, the ink bag 10 receives a force along the length thereof. Under such circumstances, the ink depletion detecting plate 20 comes in contact with the sloped portions 37, 37' formed on the cover 35 before it can move a great distance resulting in extremely small displacements. In addition, the ink bag 10 has both surfaces thereof supported by the sloped portions 37, 37' and 32, 32'. Therefore, the shaking of the ink bag 10 can be checked.

Figure 8:
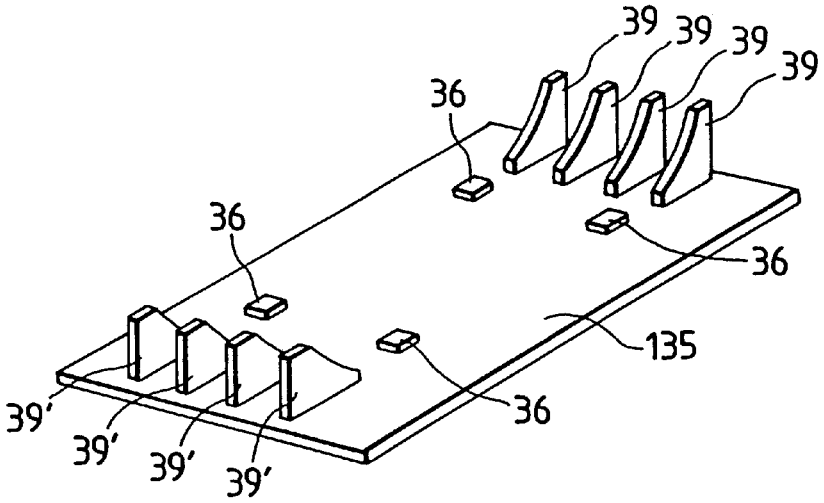
FIG. 8 is a perspective view of a cover of the case main body constructed in accordance with a third embodiment of the invention.

Reference is now made to FIG. 8 which shows an ink cover 135 constructed in accordance with a third embodiment of the invention. Like numerals are utilized to indicate like structures. A plurality of ribs 39, 39' are disposed on opposed sides of cover 135 at the width (short side) of ink bag 10 so as to cover almost all the length of the short sides of ink bag 10. This results in the formation of slopes that fit the shapes of the swollen portions 15 of the ink bag 10.

Accordingly, the ribs 39, 39' support the shapes of the swollen portions 15 of the ink bag 10 thereby checking the shaking of the ink bag 10 as a whole. Further, the absence of a recess on the cover 135 permits the surface of the cover 135 to be flat, which in turn allows for the bonding of a large adhesive label on the cover 135.

Figure 9:
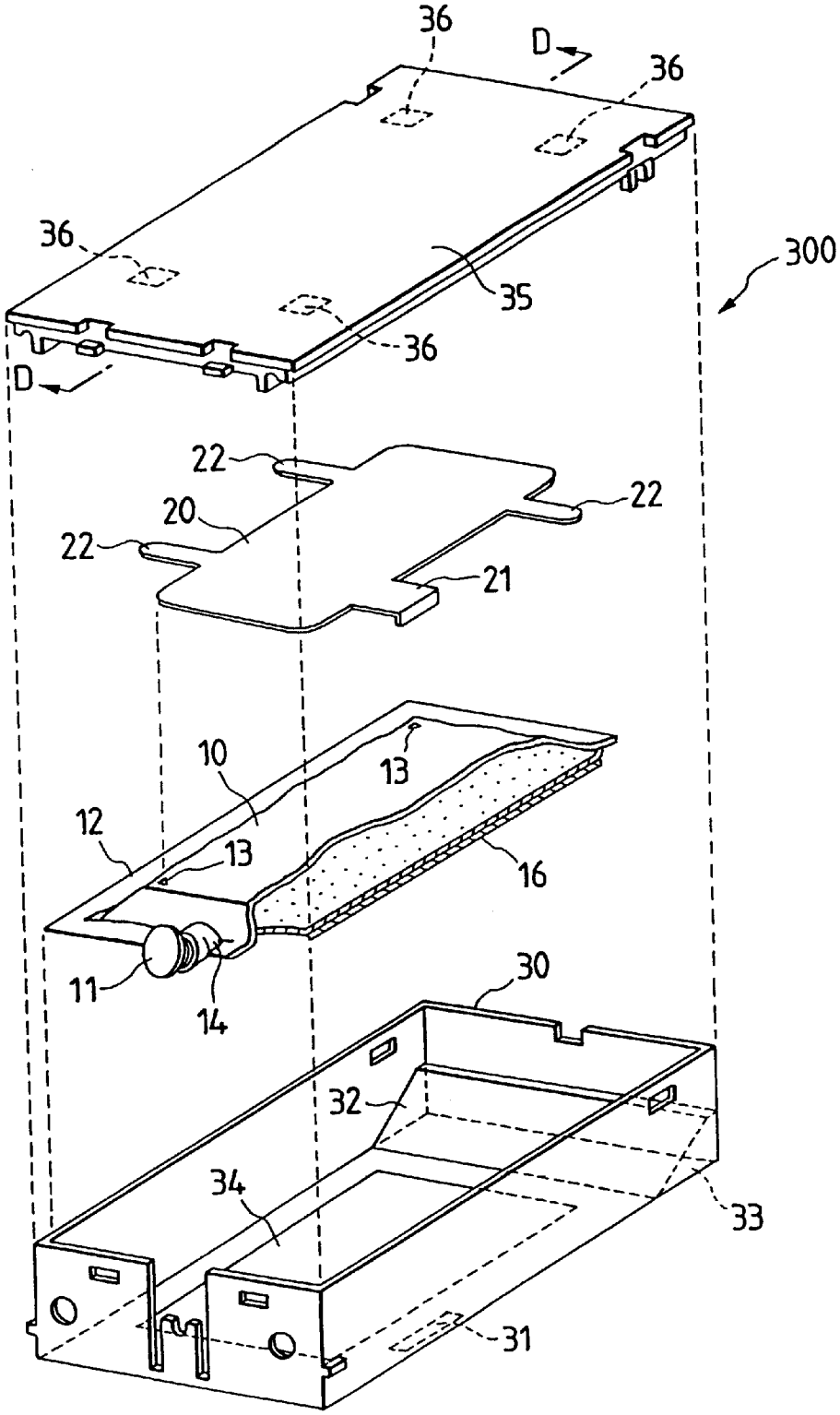
FIG. 9 is a partially cutaway exploded perspective view of a fourth embodiment of an ink cartridge constructed in accordance with the present invention.
Figure 10:
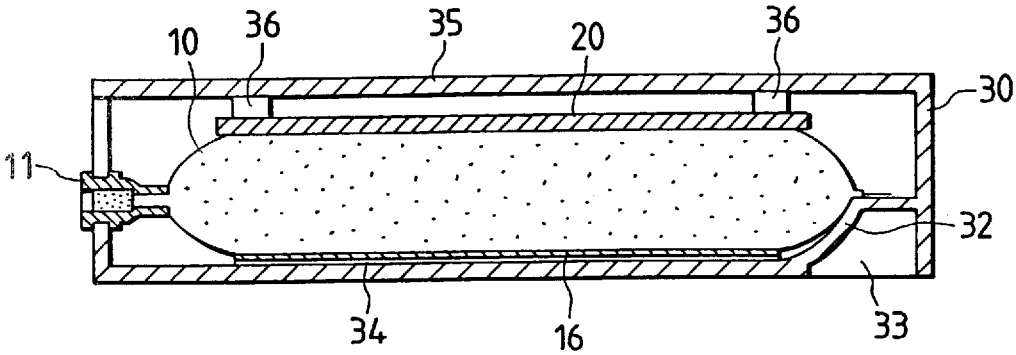
FIG. 10 is a cross-sectional view taken along line D—D of FIG. 9.

Reference is now made to FIGS. 9 and 10 in which an ink cartridge, generally indicated as 300, constructed in accordance with a fourth embodiment of the invention is shown. Like numerals are utilized to indicate like structure. Ink cartridge 300 includes a flat back member 16 secured to almost all the region of one of the flat regions of the ink bag 10. The back member is designed so as to be fixed to the bottom of the case main body 30 with the adhesive 34.

Figure 11A:
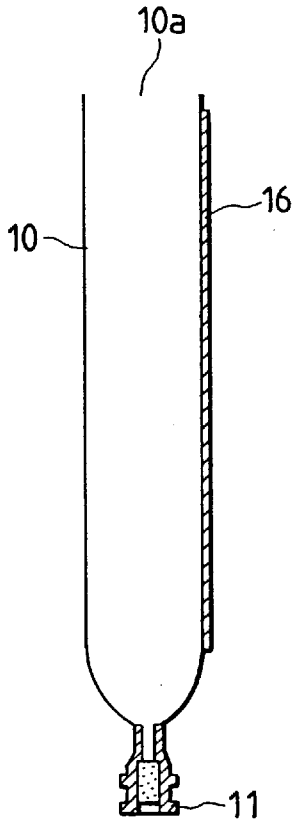
FIG. 11A is a diagram showing an ink bag used in the invention with no ink charged therein.
Figure 11B:
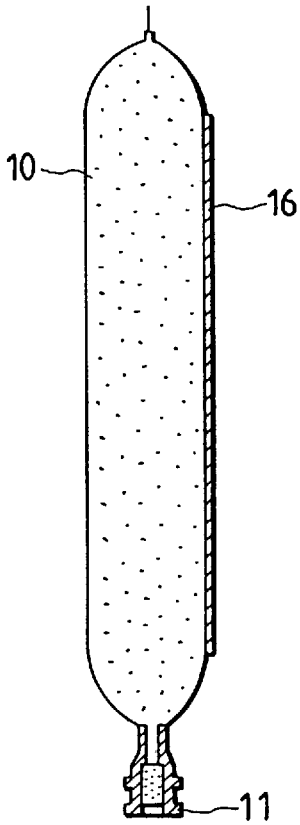
FIG. 11B is a diagram showing an ink bag with ink charged therein and with the opening thereof sealed.

Reference is now made to FIGS. 11(A) and 11(B) in which charging ink bag 10 in accordance with the invention is shown.

Ink bag 10 has an ink charge opening 10*a* arranged therein as shown in FIG. 11(A). The back member 16 is large enough to cover the majority of the flat surface when the ink bag 10, with the ink filled therein, is accommodated in the case main body 30. Back member 16 is prepared and then stuck to the surface of the ink bag 10 on the side that is fixed to case main body 30, with the long sides of the ink bag 10 expanded, using the adhesive 34, a pressure sensitive adhesive double coated tape, or the like. This is done before the ink is charged into ink bag 10.

Next, the ink bag 10 is suspended with the ink supply port 11 facing downward, and a predetermined amount of ink is charged into the ink bag 10 in the opening 10*a*. The opening 10*a* is then sealed by thermal fusion or a similar method, as shown in FIG. 11(B). This completes the preparation of the ink bag 10.

Figure 12:
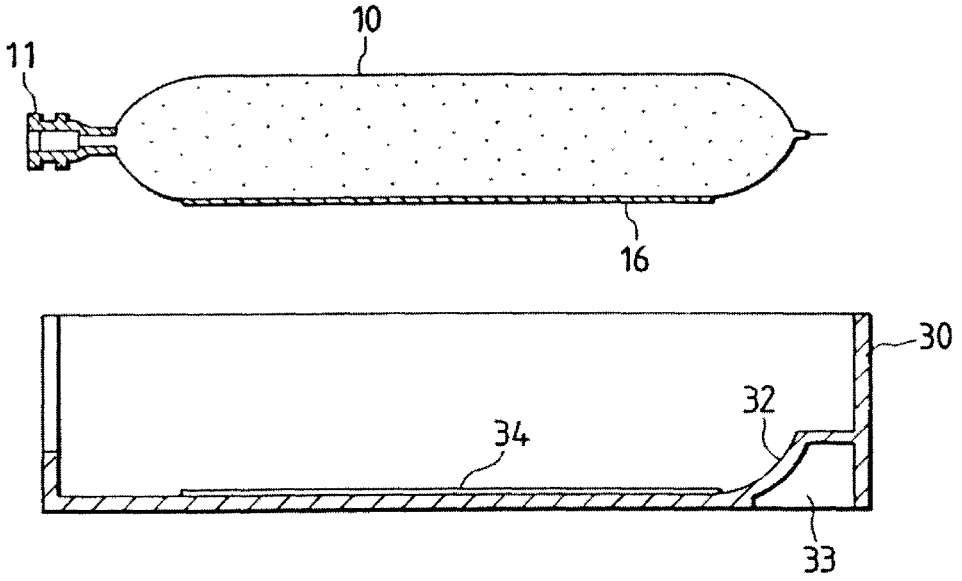
FIG. 12 is a diagram showing an ink filled ink bag and case before the ink bag is placed within the case main body in accordance with the invention.

Reference is now made to FIG. 12 in which the continued assembly of ink cartridge 1 is shown. Ink bag 10 is then kept flat by one surface of the back member 16 and the other surface of the back member 16 is fixed to the bottom of the case main body 30 with the adhesive 34 or the like. Therefore, even if the ink is shaken during assembly, ink bag 10 is fixed to the case main body 30 without any wrinkling because the fixing surface of the ink bag 10 is kept flat by the back member 16.

Figure 13:
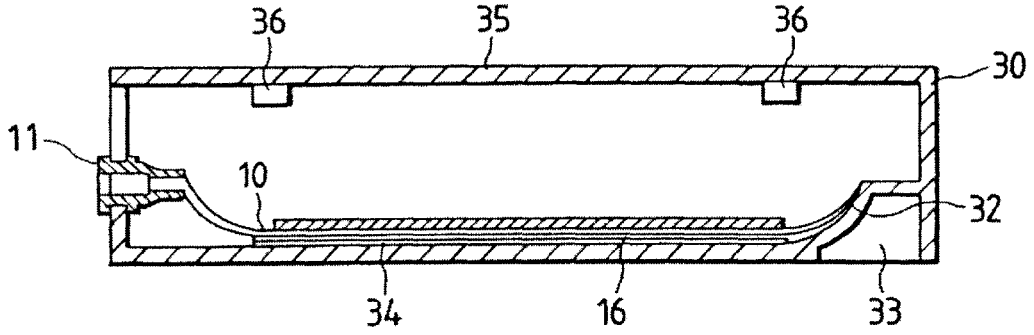
FIG. 13 is a sectional view showing a depleted ink bag secured to a case main body in accordance with the invention.

The ink cartridge 1 constructed in this manner has flat regions of the ink bag 10 that are wrinkle free and flat. Thus, the ink within the ink bag 10 is correctly discharged to the ink supply port 11. Furthermore, upon consumption of the ink, both surfaces of the ink bag 10 are brought into intimate contact with each other without being disturbed by wrinkles as shown in FIG. 13. Any remaining ink can be sensed by the ink depletion detecting plate 20 in accordance with the displacement of the detecting piece 21.

Figure 14:
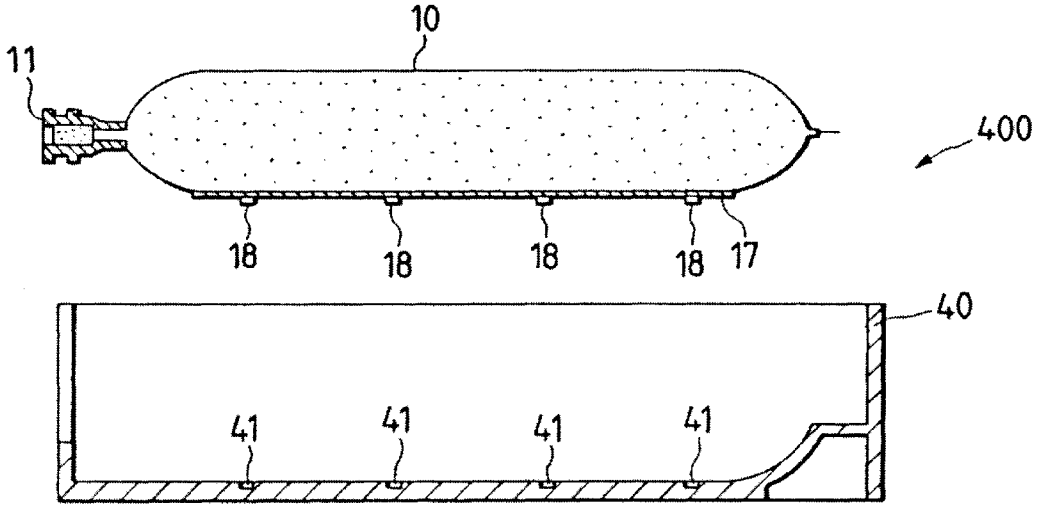
FIG. 14 is a sectional exploded view of an ink cartridge constructed in accordance with a fifth embodiment of the present invention.

Reference is now made to FIG. 14 in which an ink cartridge, generally indicated as 400, constructed in accordance with a fifth embodiment of the invention is provided. Like numerals are utilized to indicate like structure. Ink cartridge 400 includes a back member 17 affixed to a flat region of ink bag 10. A plurality of projections 18 are arranged on back member 17. Recesses 41 are formed on the bottom of a case main body 40 so as to receive the projections 18. As a result of this construction, the ink bag 10 can be correctly located on the case main body 40 only by positioning the projections 18 of the back member 17 with respect to the recesses 41 on the case main body 40 and engaging the former with the latter.

Figure 15:
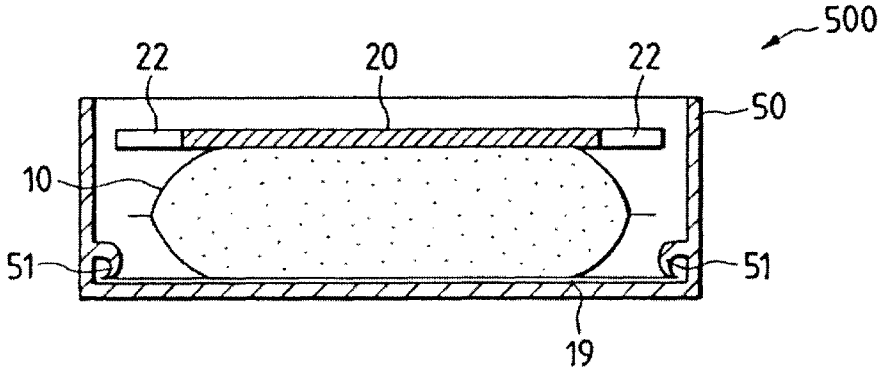
FIG. 15 is a sectional view of an ink cartridge constructed in accordance with a sixth embodiment of the present invention.
Figure 16:
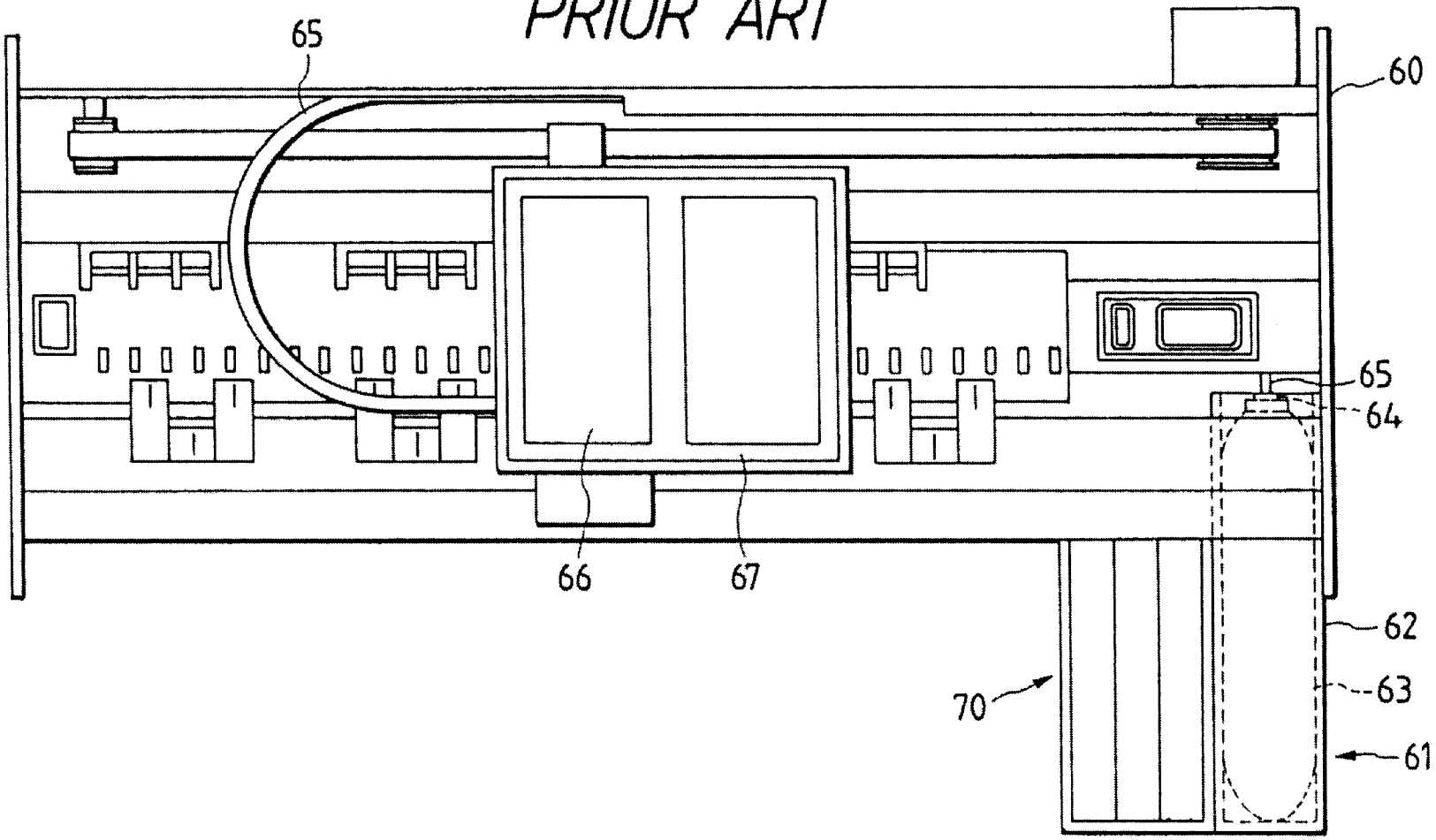
FIG. 16 PRIOR ART
FIG. 16 is a diagram showing an ink jet recording apparatus having an ink cartridge accommodated in a case in accordance with the prior art.
Figure 17:
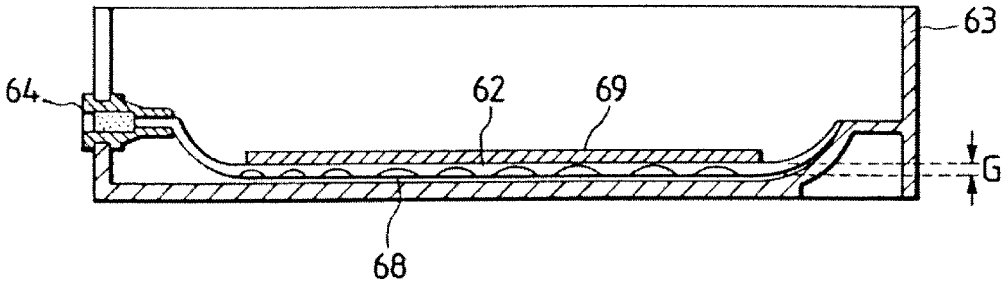
FIG. 17 PRIOR ART
FIG. 17 is a diagram showing an ink cartridge without any ink in an ink bag secured to a case main body in accordance with the prior art.

Reference is now made to FIG. 15 in which an ink cartridge, generally indicated as 500, constructed in accordance with a sixth embodiment of the invention is provided. Like numerals are utilized to indicate like parts. Ink cartridge 500 includes a case main body 50. A plurality of retaining members 51 are arranged on the inner side surfaces of case main body 50. A back member 19 is secured to a flat surface of the ink bag 10 and is releasably secured to the case main body 50 by retaining members 51. As a result of this construction, when the back member 19 is pushed into the bottom of the case main body 50, both end portions of the back member 19 are fixed by the retaining members 51.

In each of the aforementioned embodiments, the back member is bonded to the flat surface of the ink bag 10 before charging the ink into the ink bag 10. However, the back member may be bonded to the flat region of the ink bag even after the ink has been charged into the ink bag. This can be done without any wrinkling as long as the ink bag with the ink filled therein is placed on a flat plate and tension is applied in all directions of the ink bag in order to prevent any shaking of the ink bag.

By providing a flat flexible ink bag that is formed so as to be substantially rectangular and that has an ink supply port formed on one short side thereof; an ink depletion detecting plate that is fixed to one flat region of the ink bag and that has an outwardly projecting detecting piece; a case main body that accommodates the ink bag while fixing the other flat region of the ink bag to the bottom thereof; and a cover that covers an opening of the case main body, and as arranging, on at least one long side of the ink depletion detecting plate, projecting pieces such as to extend outward beyond an outer edge of the ink bag and such as to allow front ends thereof to come in contact with a side wall of the case main body vibration of the ink bag may be checked. Because, the projecting pieces formed on the ink depletion detecting plate come in contact with the side wall of the case main body at short strokes, so that the ink bag can be reliably prevented from being damaged by the ink depletion detecting plate while suppressing deformation of the ink bag at the time the ink bag is subjected to vibrations due to transportation or the like the integrity of the ink bag is preserved.

It will thus be seen that the objects set forth above, among those made apparent from the preceding description, are efficiently attained and, since certain changes may be made in carrying out the above process and in the construction set forth without departing from the spirit and scope of the invention, it is intended that all matter contained in the above description and shown in the accompanying drawings shall be interpreted as illustrative and not in a limiting sense.

It is also to be noted that the following claims are intended to cover all of the generic and specific features of the invention herein described and all statements of the scope of the invention which, as a matter of language, might be said to fall therebetween.

What is claimed is:

1. A method of constructing an ink cartridge comprising the steps of:

providing an ink bag with an ink supply port at one end and an ink charge opening at an opposite end thereof; then affixing a back member to an external flat side of said ink bag; then suspending said ink bag with said ink supply port facing downward and charging a predetermined amount of ink into said ink bag via said ink charge opening; then permanently sealing said ink charge opening;

keeping said ink bag flat with said back member; and affixing said back member to the bottom of a case main body.

2. A method according to claim 1, wherein said back member is large enough to cover the majority of said flat surface of said ink bag.

3. A method according to claim 1, wherein said back member is affixed to said ink bag using an adhesive.

4. A method according to claim 1, wherein said ink charge opening is sealed by thermal fusion.

5. A method according to claim 1, wherein said back member is affixed to the bottom of said case main body using an adhesive.

* * * * *